US009388600B2

(12) United States Patent
Leathers

(10) Patent No.: US 9,388,600 B2
(45) Date of Patent: Jul. 12, 2016

(54) TABLE TENT

(71) Applicant: Angela Leathers, Newburgh, NY (US)

(72) Inventor: Angela Leathers, Newburgh, NY (US)

( * ) Notice: Subject to any disclaimer, the term of this patent is extended or adjusted under 35 U.S.C. 154(b) by 0 days.

(21) Appl. No.: 14/532,154

(22) Filed: Nov. 4, 2014

(65) Prior Publication Data

US 2016/0123034 A1 May 5, 2016

(51) Int. Cl.

| | |
|---|---|
| ***E04H 15/02*** | (2006.01) |
| ***E04H 15/58*** | (2006.01) |
| ***E04H 15/34*** | (2006.01) |
| *A47B 37/04* | (2006.01) |

(52) U.S. Cl.

CPC ..... *E04H 15/02* (2013.01); *E04H 15/34* (2013.01); *E04H 15/58* (2013.01); *A47B 37/04* (2013.01)

(58) Field of Classification Search

CPC ..... A47B 37/04; A47G 19/26; E04H 15/02; E04H 15/58

USPC ..... 135/161, 96, 117; 108/50.12

See application file for complete search history.

(56) References Cited

U.S. PATENT DOCUMENTS

| | | | | | |
|---|---|---|---|---|---|
| 526,942 | A | * | 10/1894 | Rhoads et al. | 135/137 |
| 814,473 | A | * | 3/1906 | Patterson | 135/96 |
| 2,341,672 | A | * | 2/1944 | Terrill | 108/42 |
| 2,790,452 | A | * | 4/1957 | Dusek | 135/120.3 |
| 3,176,699 | A | | 4/1965 | Rollins | |
| 3,221,756 | A | * | 12/1965 | Rupright | 135/98 |
| 3,233,618 | A | * | 2/1966 | Ferrier | 108/42 |
| 3,307,565 | A | * | 3/1967 | Luccarelli | 108/42 |
| 3,417,764 | A | * | 12/1968 | Hemenway | 135/140 |
| 3,744,500 | A | | 7/1973 | Briggs | |
| D279,833 | S | | 7/1985 | Eberle | |
| 4,685,483 | A | * | 8/1987 | Balazs | 135/152 |
| 4,708,183 | A | * | 11/1987 | Figueroa | 108/90 |
| 5,215,108 | A | * | 6/1993 | Sprague | 135/90 |
| 5,311,813 | A | | 5/1994 | Fairbanks et al. | |
| 5,564,452 | A | * | 10/1996 | Kitchen | A45B 11/00 135/161 |
| 5,832,943 | A | | 11/1998 | Johnson | |
| 5,857,658 | A | * | 1/1999 | Niemiec | 248/534 |
| 5,975,325 | A | | 11/1999 | Wallace | |
| 6,499,411 | B2 | | 12/2002 | Brown | |
| 6,866,054 | B1 | | 3/2005 | Collins | |
| 7,896,015 | B2 | * | 3/2011 | Milano et al. | 135/90 |
| 8,069,871 | B2 | * | 12/2011 | Schneider | 135/96 |
| 8,132,585 | B2 | | 3/2012 | Rothweil | |
| 8,528,578 | B2 | * | 9/2013 | Mowatt, Sr. | E04F 10/0603 135/117 |
| 9,125,467 | B2 | * | 9/2015 | Randel | A45C 11/26 |
| 2003/0106471 | A1 | | 6/2003 | Rivers | |
| 2005/0161071 | A1 | * | 7/2005 | Tseng | E04H 15/32 135/158 |
| 2006/0081285 | A1 | * | 4/2006 | Gomez | 135/134 |

FOREIGN PATENT DOCUMENTS

| | | | |
|---|---|---|---|
| CA | 2625145 | A1 | 9/2008 |

OTHER PUBLICATIONS

"Dura-Tent FT-200 Outdoor Tabletop Food Screen—Banquet Size" (www.amazon.com, accessed Mar. 13, 2014).

* cited by examiner

*Primary Examiner* — Noah Chandler Hawk

(57) ABSTRACT

A table tent includes a roof, posts connected to and supporting the roof, at least one sidewall around at least a portion of a perimeter of the table tent. The posts may be attached to a surface upon which the table tent rests. The sidewalls may extend vertically from the roof to the surface upon which the table tent is resting and may extend around the entire perimeter of the table tent. The sidewalls may be retractable such that at least a portion of the table tent is exposed when the sidewalls are in a retracted position.

8 Claims, 10 Drawing Sheets

TABLE TENT

TECHNICAL FIELD

This invention relates to table tents for protecting objects resting on a surface within from outside disturbances such as bugs, precipitation, wind and the like.

DESCRIPTION OF RELATED ART

Millions of Americans enjoy a picnic, whether at the beach, in an established shelter, out in the woods, or in their backyards. Many people find that going on a picnic is an inexpensive and fun way to entertain a family or group of friends. On picnics, people often play volleyball, badminton, horseshoes, softball, etc., usually in a area adjacent to where food is being served. They bring along their radios and cassette players to enjoy music as they picnic and party.

Food and beverages are considered essential ingredients at any picnic or barbecue. Picnic foods can range from very casual to elegant spreads, but no matter how simple or complex a meal may be, it is important that foods are covered to be protected from insects. Flies always swarm around picnic food. These nasty insects carry diseases on their legs and bodies that can be easily transferred to unprotected foods. The occasional rainstorm can also cause havoc on picnics and other outdoor food displays.

Similar problems plague displays of other objects in addition to food items. For example, a gust of wind may scatter brochures resting unprotected on a display table.

While large enclosed tents have been proposed which cover an entire dining area, table and seating included, these tents can be bulky and difficult to set up. Likewise, other approaches towards protecting food and other items outdoors do not offer the ease of use, aesthetic appeal, effectiveness or economy of the table tent described herein.

SUMMARY

This disclosure provides table tents.

In an aspect, a table tent includes a roof at least partially constructed of a waterproof and substantially clear flexible material, at least one post connected to and supporting the roof, at least one sidewall constructed of an open material, the one or more sidewalls extending vertically from the roof to a surface upon which the table tent is resting and extending laterally around a perimeter of the roof, and at least one attachment configured to removably attach one or more post to the surface upon which the table tent is resting.

In another aspect, the roof of a table tent is rectangular and comprises four posts connected to and supporting each corner of the roof.

In another aspect, at least one sidewall is at least partially retractable from an extended position to a retracted position in which at least a portion of a side of a table tent is exposed.

In another aspect, a table tent includes at least two sidewalls, each sidewall being at least partially retractable from an extended position to a retracted position such that when two sidewalls are in a retracted position, at least two portions of one or more sides of the table tent are exposed.

In another aspect, at least one post of a table tent is removably connected to a roof.

In another aspect, an attachment includes a threaded member configured to impinge an opposite side of the surface from a post of a table tent.

In another aspect, a roof of a table tent is rectangular with an elevated ridge aligned with a longer dimension of the roof.

In another aspect, at least one gutter is configured to at least partially redirect precipitation cascading from at least a portion of the roof.

In another aspect, the table tent includes at least two sidewalls configured to removably attach to one another.

In another aspect, the sidewall extends from the roof to a predetermined distance above the surface upon which the table tent is resting sufficient to allow a user to access an interior of the table tent without contacting the sidewall.

In another aspect, the table tent further comprises an outer sidewall constructed of a waterproof flexible material extending vertically from the roof adjacent to and distal from the at least one sidewall constructed of an open material.

DETAILED DESCRIPTION

Embodiments of a table tent are described herein. While aspects of the described table tent can be implemented in any number of different configurations, the embodiments are described in the context of the following exemplary configurations. The descriptions and details of well-known components and structures are omitted for simplicity of the description.

The description and figures merely illustrate exemplary embodiments of the table tent. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

Figure 1:
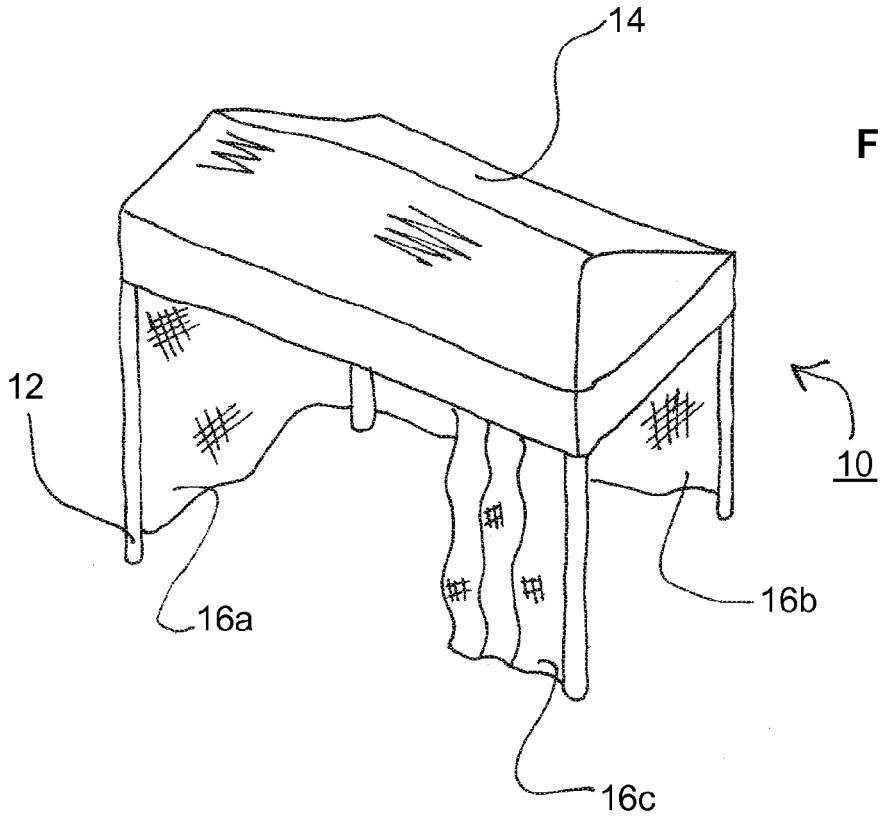
FIG. 1 is a top perspective view of a table tent according to an embodiment of the present application.

Turning now to FIG. 1, an embodiment of a table tent 10 is shown having a rectangular shape and includes posts 12 and a roof 14. Sidewalls 16*a*, 16*b* and 16*c* descend from the roof 14. Although shown in FIG. 1 as having a rectangular shape, a table tent according to the present application may take any shape. Examples include circular or elliptical shapes, rectangular, square or other polygonal shapes, etc.

Figure 7:
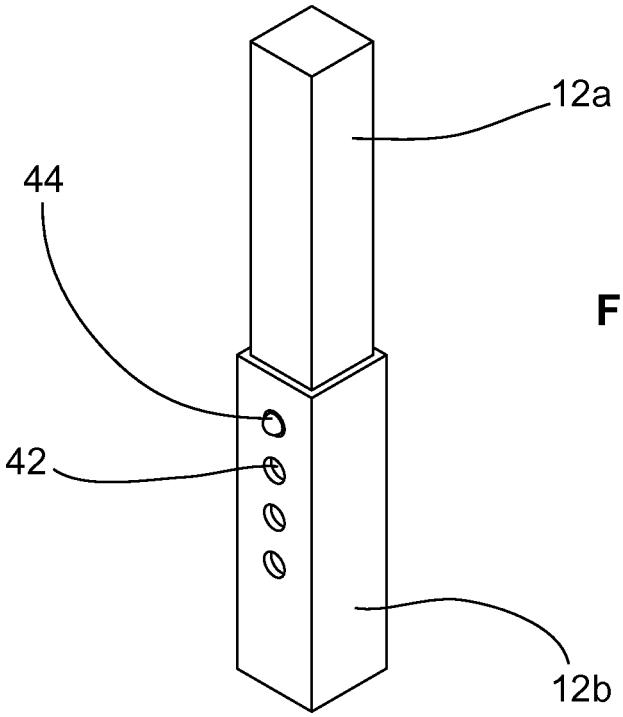
FIG. 7 is a top perspective view of a telescoping post according to another embodiment of the present application.
Figure 9:
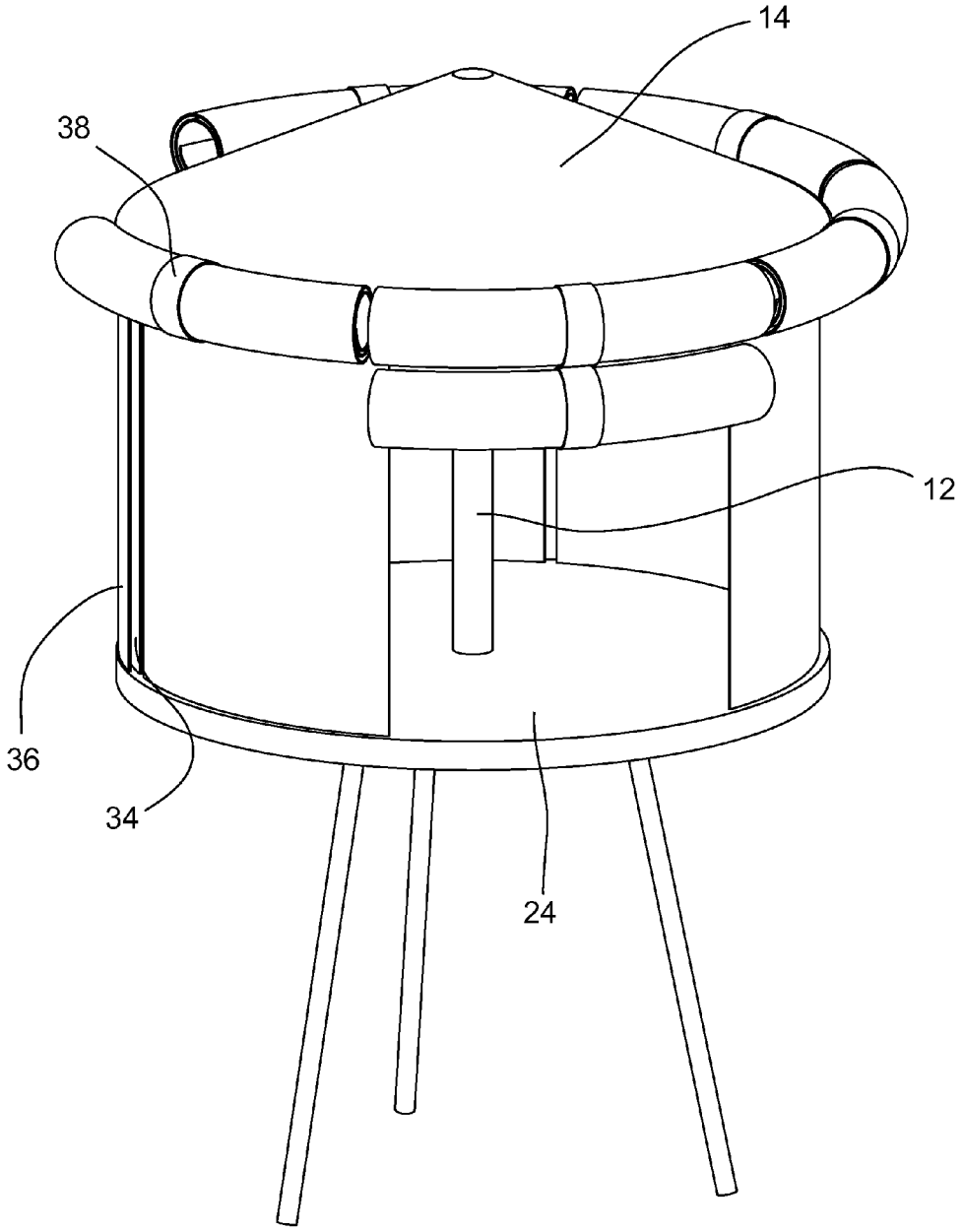
FIG. 9 is a top perspective view of a table tent and table according to another embodiment of the present application.

The posts 12 may be constructed of any suitable rigid material, including, for example, wood, metal, plastic, etc. The posts 12 may be solid or hollow. The cross section of each post is not limited and may be, for example, substantially circular, substantially polygonal, etc. The posts 12 may be configured as having a fixed height or may be configured with an adjustable height. For example, a post may be configured with a screw collet or with a spring button which engages perforations in an outer post segment which permit a post comprised of two or more telescoping segments to vary in height and which permit a user to selectively vary the post's height. An example is shown in FIG. 7 of a first post segment 12*a* with holes 42 and a telescoping second post segment 12*b* with a spring loaded pin 44 configured to engage one of the holes 42. In another example, a post may be configured with multiple segments which attach end-to-end. Accordingly, in this example, the height of a post may be determined by the number of post segments attached to one another. A table tent may have one or more posts and the posts may be located at a perimeter of a table tent and/or within the table tent. In the case of a table tent having a polygonal shape, posts may be located at corners of the table tent, as shown in FIG. 1 and/or such a table tent may include posts along any peripheral side of the table tent not in a corner. In another example of a table tent, such as a table tent having a circular shape, the table tent may comprise only one post at a center of the table tent, as shown in FIG. 9.

The roof 14 may be constructed of a flexible or rigid material. Examples of possible flexible roof materials include woven and nonwoven fabrics such as nylon, canvas, felt, etc. and flexible sheet material such as plastic, for example vinyl. Examples of possible rigid materials include rigid plastic, wood, metal, etc. In one embodiment, the roof is constructed of a water resistant or water proof material which would permit the roof to protect objects underneath it from precipitation or other falling liquids. The roof may be clear, translucent or opaque. In one embodiment, the roof is substantially clear so as to allow a user to see through the roof to identify objects within the table tent. The roof may be constructed of any combination of one or more materials.

Figure 5:
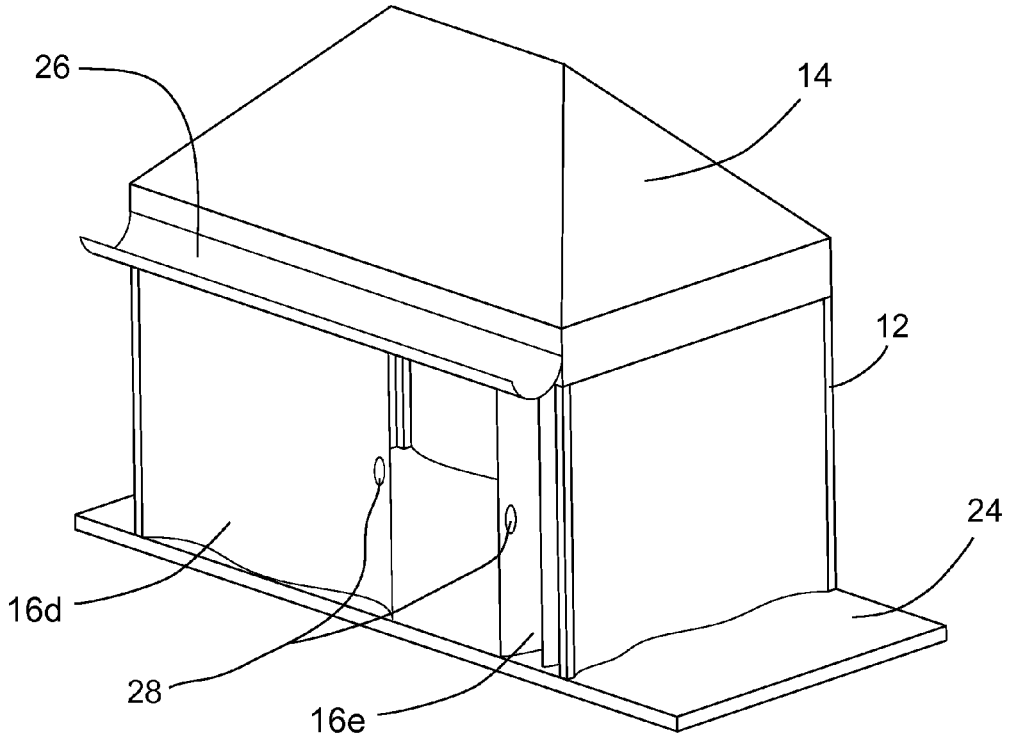
FIG. 5 is a top perspective view of a table tent and surface according to another embodiment of the present application.
Figure 6:
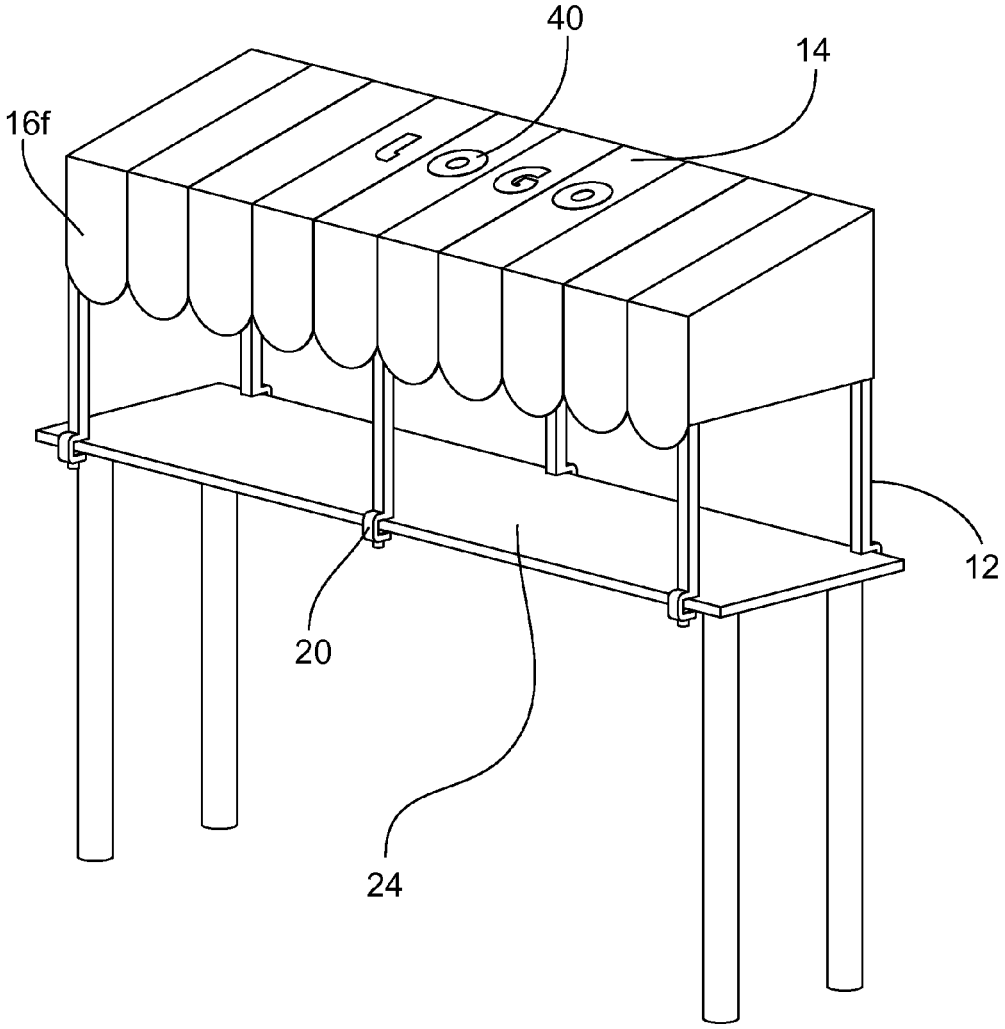
FIG. 6 is a top perspective view of a table tent and table according to another embodiment of the present application.

While the roofs 14 shown in FIGS. 1 and 5 are hipped roofs with elevated ridges aligned along their longest dimension, other roof shapes are possible as well. For example, the roof of a rectangularly shaped table tent may also take the form of a shed roof, an example of which is shown in FIG. 6, a gable roof, a gambrel roof, a mansard roof, a flat roof, etc. The roof of a circularly shaped or elliptically shaped table tent may take the form of, for example, a cone, as shown in FIGS. 9 and 12.

The roof of the table tent may be supported by an internal roof structure or may be self-supporting. For example, an interior framework of rigid rods or tubes may be constructed to support a roof comprising a flexible material such as vinyl. In another example, a roof constructed of rigid material such as rigid plastic sheets may be self-supporting.

Figure 12:
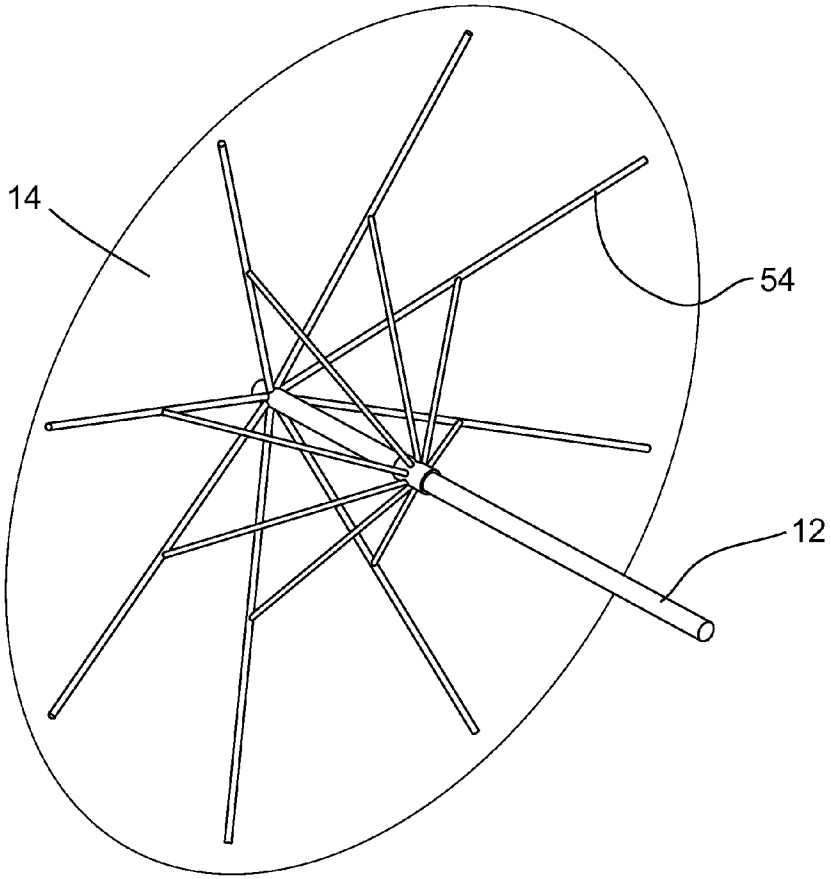
FIG. 12 is a bottom perspective view of a table tent and table according to another embodiment of the present application.

FIG. 12 shows one example of a roof structure arrangement for a circular table tent. In the figure, sidewalls are not shown for clarity. Roof structure elements 52 are hinged to one another in an arrangement similar to the structure of a collapsible umbrella. Accordingly, such a roof structure allows for collapsing the table tent into a smaller volume for transport or storage when not in use.

Figure 13:
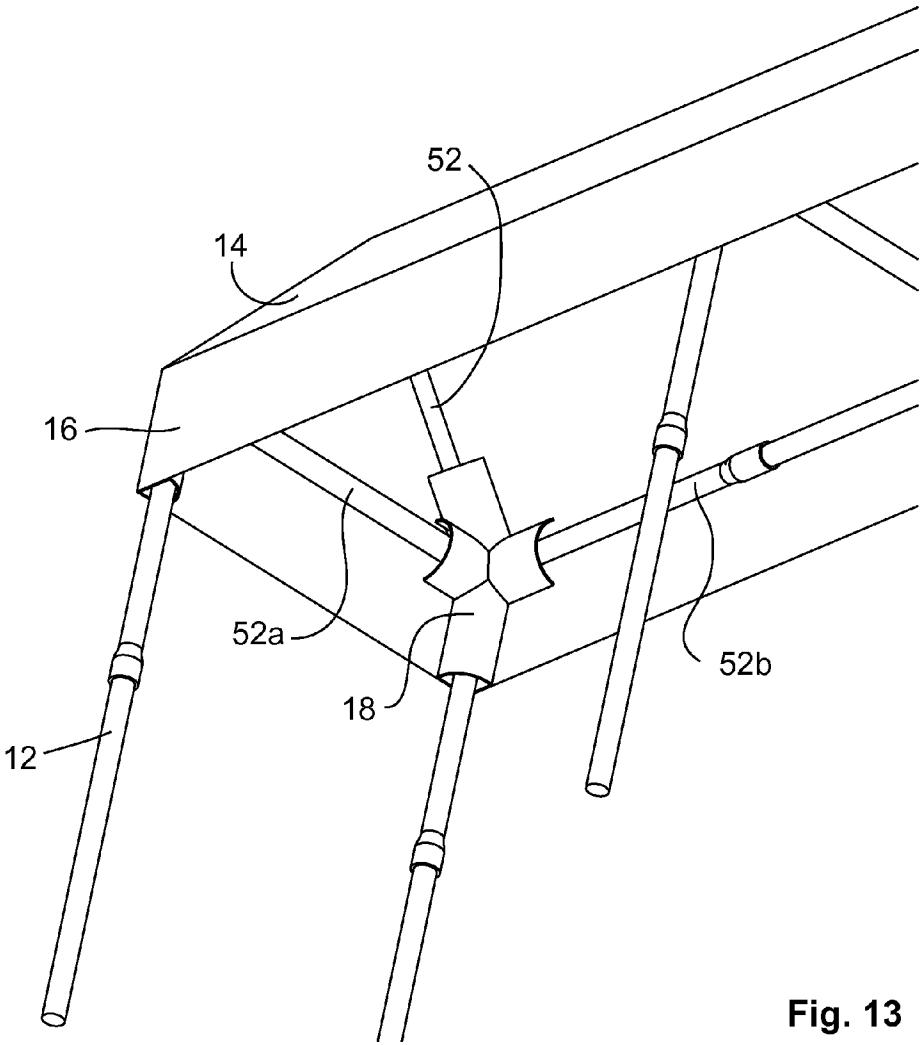
FIG. 13 is a partial bottom perspective view of a table tent and table according to another embodiment of the present application.

FIG. 13 shows another example of an arrangement of roof structure elements 52, but in a rectangular table tent. As shown, roof structure elements 52 may be single members, such as roof structure element 52*a* but may also be collapsible members, such as roof structure element 52*b*, which is an element that may be collapsed into two segments similar to the post shown in FIG. 8.

Figure 10B:
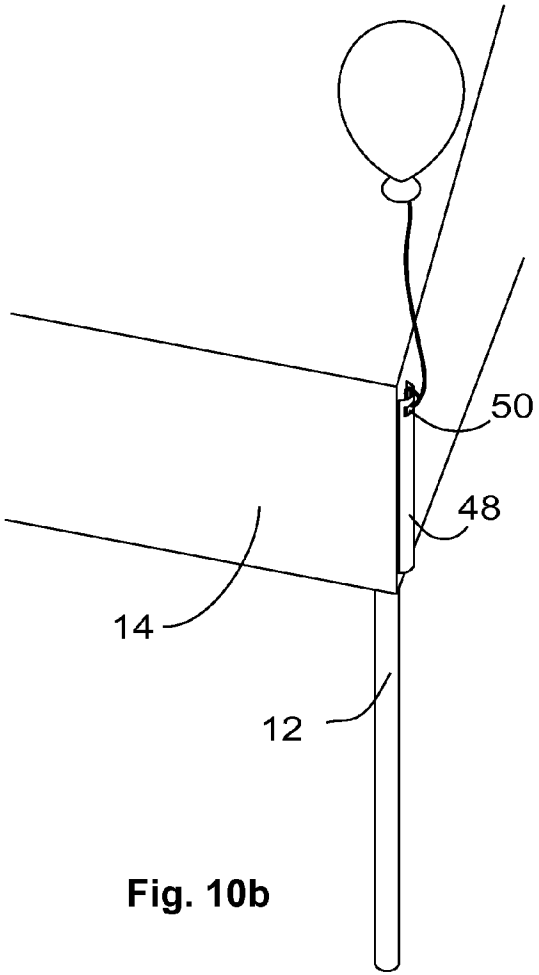
FIG. 10*b* is a partial top perspective view of a table tent with another accessory holder according to another embodiment of the present application.
Figure 10A:
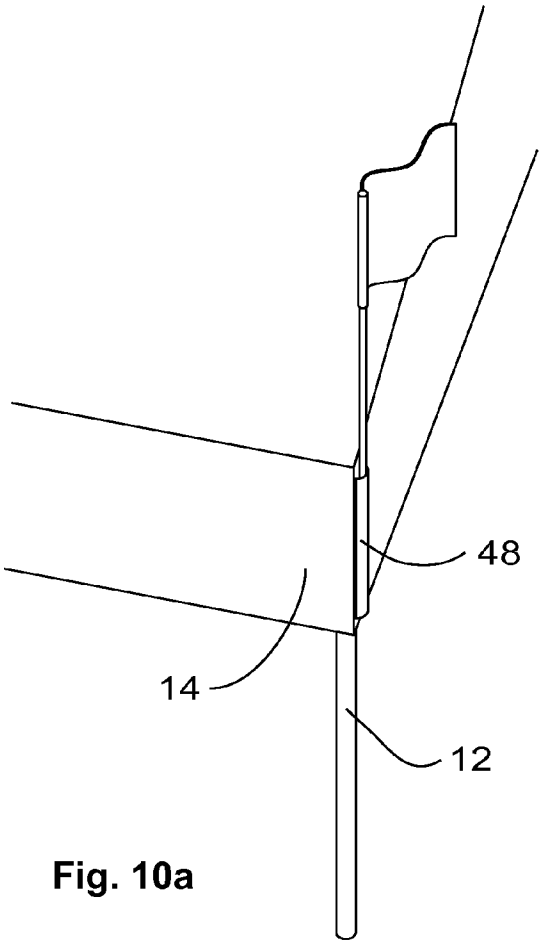
FIG. 10*a* is a partial top perspective view of table tent with an accessory holder according to another embodiment of the present application.

The roof may include printed indicia such as lettering. For example, the indicia may be used as advertising or to provide information regarding the contents of the table tent. In the example shown in FIG. 6, the indicia "LOGO" 40 is printed or stitched onto the roof 14. In another example shown in FIG. 10*a*, a table tent may be provided with a banner or flag bearing advertising. As shown in FIG. 10*a*, the roof 14 may be provided with an accessory holder 48 configured to hold such a banner or flag. In yet another example, a table tent is provided with an attachment point for securing balloons to the table tent. In the example shown in FIG. 10*b*, an accessory holder 48 is configured to permit securing a balloon string thereto. In the example shown, a pouch-like accessory holder 48 is provided which is configured to hold a banner of flag, as shown in FIG. 10*a*, as well as provide an attachment point for a balloon via a cutout 50 in the side of the accessory holder. The balloon string may be fed through this cutout 50 and tied, as shown, or may be fed through the pouch and through a hole in the bottom of the pouch (not shown).

The roof may also be provided with one or more gutters configured to redirect precipitation cascading from the roof surface to one or more drainage points along the perimeter of the roof. For example, as shown in FIG. 5, a gutter 26 is provided which is configured to redirect precipitation cascading from the roof along one side of the table tent to drainage points at corners of that side of the table tent. Gutters may be provided along one side, more than one side or all sides of the table tent. Similarly, any gutter may extend fully or partially along a side of a table tent.

Figure 11:
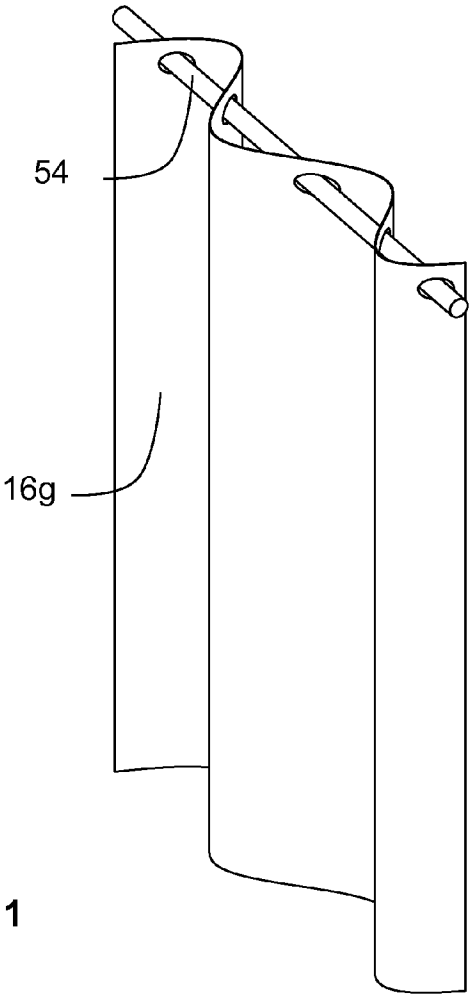
FIG. 11 is a top perspective view of a sidewall panel and rod according to another embodiment of the present application.

The table tent 10 may optionally comprise one or more sidewalls. Any sidewall may be configured to hang from beneath the roof 14 or may be suspended between posts 12. Any sidewall may extend vertically from the roof to a surface on which the table tent is resting or any portion therebetween. A gap may exist between any sidewall and the roof or between any sidewall and the surface on which the table tent is resting or both. In one embodiment, sidewalls of a table tent extend to the surface the table tent is resting upon. Any sidewall may extend laterally to completely cover a side of the table tent or may extend laterally to cover only a portion of a side of the table tent. In one embodiment, sidewalls extend around an entire perimeter of the table tent. A table tent may comprise one continuous sidewall wrapping around one or more sides of the table tent or may comprise a plurality of sidewalls each covering one or more sides of the table tent or a portion thereof. Any sidewall may be repositionable such that the sidewall can be manipulated by a user from an extended position to a retracted position, much like a shower curtain or window curtain. In one example, shown in FIG. 11, a sidewall panel 16*g* is hung from a rod 54. Such a rod may be attached to the table tent at or near the bottom of the roof. Such a rod may also comprise part of the roof structure or may be separate from the roof structure.

For example, a table tent may include a retractable sidewall which exposes a portion of a side of the table tent when in its retracted position. In another example, a table tent may include two or more retractable sidewalls. In this example, the retractable sidewalls may expose two sides of the table tent when in their retracted positions. In yet another example, shown in FIG. 5, the retractable sidewalls may cooperate to expose the same side of the table tent when in their retracted position, similar to how a pair of window curtain panels may be retracted to either side of a window to expose the window. In FIG. 5, a table tent is shown with one sidewall panel 16*d* in an extended position while a cooperating sidewall panel 16*e* is in an retracted position. Cooperating sidewall panels may be removably attached to one another by a closure 28 such as hook-and-loop fasteners, snaps, toggles, buttons or magnets. Similarly, sidewalls and/or sidewall panels may be retained in their retracted position by tie-backs or other means. Sidewalls and/or sidewall panels may also be permanently or removably attached along one vertical edge to poles of the table tent.

In the embodiment shown in FIG. 1, for example, a table tent 10 is shown having several sidewalls 16*a*, 16*b* and 16*c*. Sidewalls 16*a* and 16*b* are shown in an extended position and may be separate sidewalls or may be portions of a single sidewall. Sidewall 16*c* is shown in a retracted position. The right side of table tent 10, between sidewall 16*b* and 16*c*, does not have a sidewall.

Any sidewall may be constructed of a woven or nonwoven fabric or a flexible sheet material. Examples include window screen, vinyl, nylon fabric, etc. Sidewalls may be constructed of different materials. For example, if a rectangular table tent includes four sidewalls, three may be constructed of window screen and a fourth may be constructed of clear vinyl. Sidewalls of a table tent may all be constructed of the same material or may be constructed of different materials. Similarly, any sidewall may be constructed of a single material or any combination of materials. In one embodiment, sidewalls are constructed of an open material such as window screen, mesh or netting which allows air to circulate into the table tent but prevents entry by bugs, other pests or foreign debris. Such an open material may also advantageously reduce air currents within the table tent to prevent excessive wind from causing objects within the table tent to be disturbed. An open material also permits a user to see into the table tent.

In another example, an example of which is shown in FIG. 9, a table tent may be provided with two or more sets of sidewalls. For example, a table tent may be provided with an inner sidewall 34 constructed of window screen netting and an outer sidewall 36 constructed of waterproof vinyl. In this example, the outer sidewall may be deployed to provide protection from precipitation and may be retracted in nice weather. With the outer sidewall retracted, however, the user still has the advantage of the inner sidewall configured to prevent entry by insects into the table tent. FIG. 9 shows six outer sidewall panels 36 with five retracted. As shown, the sidewall panels may be rolled and secured by a removable fastener 38, such as a hook-and-loop fastener, a button, a tie, etc. FIG. 9 also shows six inner sidewall panels 34 with one retracted and rolled.

In still another example, a table tent may be configured for use as a food protector or "sneeze guard." In this example, the roof may be constructed of a waterproof material and a sidewall facing food patrons may also be constructed of waterproof material. An example is shown in FIG. 6. As shown, the patron-facing sidewall 16*f* extends down from the roof but stops some distance short of the surface 24 upon which the table tent is resting to allow for the patrons to access items within the tent, but preventing any undue contamination of those items from the patrons themselves. In this example, the roof and sidewalls may be constructed of a relatively clear waterproof material so that patrons may see into the table tent through the roof and sidewalls.

Figure 2:
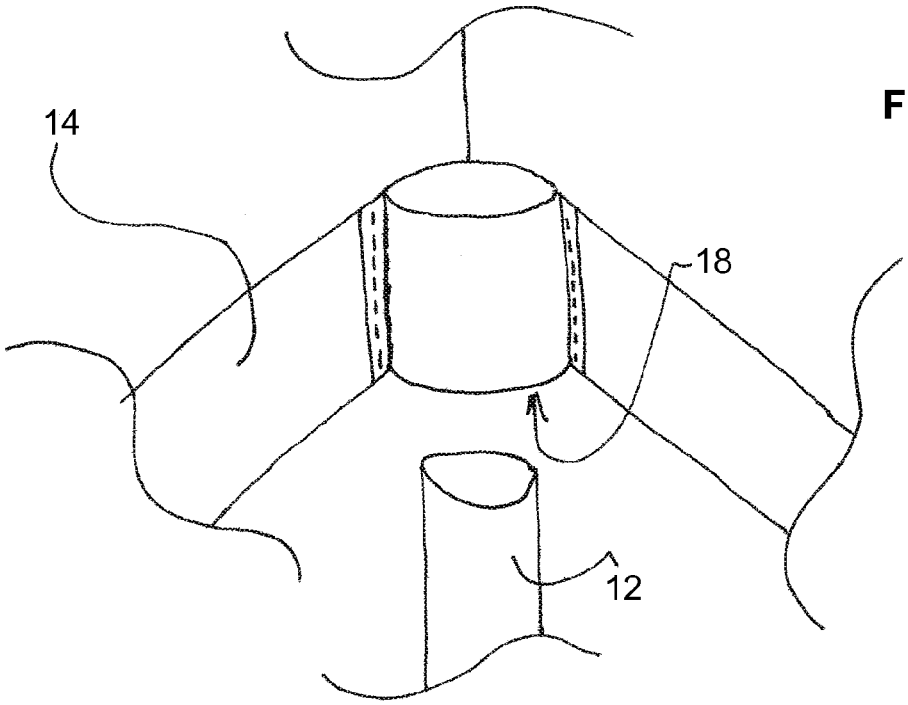
FIG. 2 is an interior detail perspective view of a pole and roof according to another embodiment of the present application.

The posts 12 may be attached to the roof 14 in any suitable manner. In one example, shown in FIG. 2, a roof 14 may include a pocket 18 into which a post 12 may be inserted. If the roof 14 were to be constructed of fabric, for example, the pocket 18 may be stitched to the main roof material. In this example, posts 12 may be separated from the roof 14 for storage of the table tent 10. FIG. 13 shows other examples of pockets 18 which receive posts 12 and also roof support elements 52.

Figure 8:
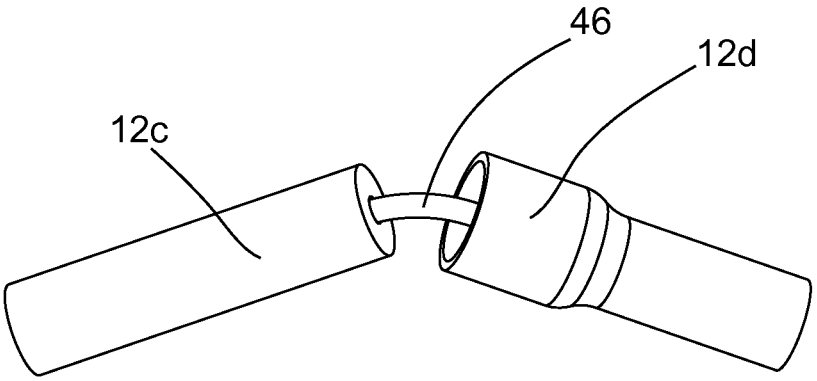
FIG. 8 is a top perspective view of a collapsible post according to another embodiment of the present application.

In another example, the posts 12 may be hingably connected to the roof 14 or roof structure. In this example, a user could hinge the posts 12 from a deployed, vertical position to a stowed position when preparing the table tent 10 for storage. In another example, the roof structure may be constructed such that it collapses inwardly and the posts remain in a fixed orientation relative to the roof. In other words, while the perimeter of the table tent shrinks as the table tent roof structure collapses, the posts remain substantially perpendicular to the table or other surface upon which the table tent is resting. In another example, the posts and/or any roof structure may be hinged or collapsible to improve the degree to which the table tent may be collapsed. For example, as shown in FIG. 8, a post segment 12*c* is joinable to another post segment 12*d* by fitting a female end of one segment 12*d* over a male end of the other segment 12*c*. In this example, such joining may be encouraged by an elastic cord 46 between post segments 12*c* and 12*d*. Such a joint may also be used to attach roof structure elements. Such a post 12 is also shown in FIG. 8 in an assembled state.

Optionally, the table tent may be attached to a table, countertop or other surface. Preferably, the attachment would be removable. For example, in the case of a table tent intended for use with a folding table, it would be advantageous for the table tent to be removably attached to the table to prevent the table tent from becoming displaced by wind or a bump from a person or animal. Yet, after use, it would be advantageous to be able to separate the table tent from the folding table so that each may be stored compactly and separately from one another.

Figure 3:
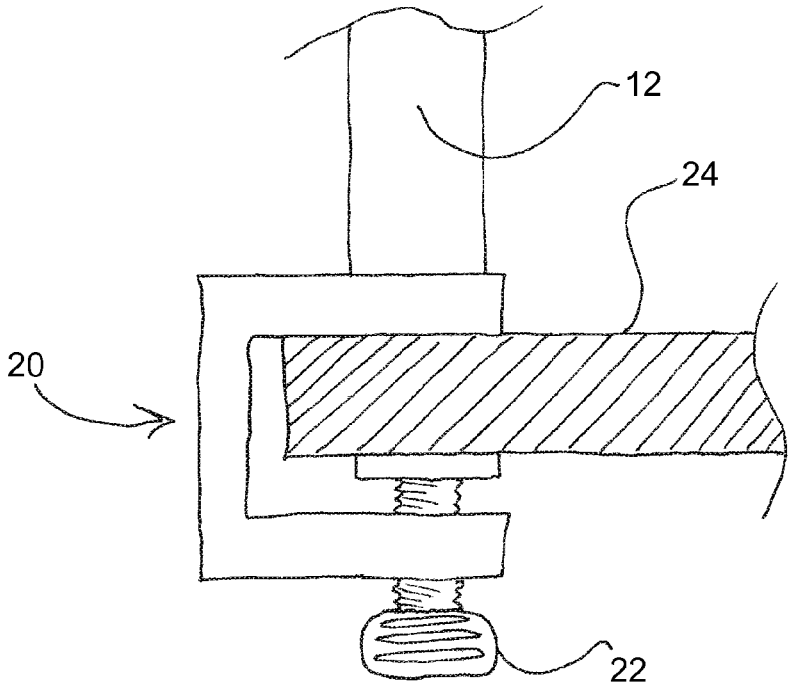
FIG. 3 is a partial side cross-sectional view of a table attachment according to another embodiment of the present application.

One example of a table attachment 20 is shown in FIG. 3. As shown, an end of a post 12 includes a threaded fixation screw 22 for clamping the table attachment to the edge of a table, countertop or other surface 24.

Figure 4:
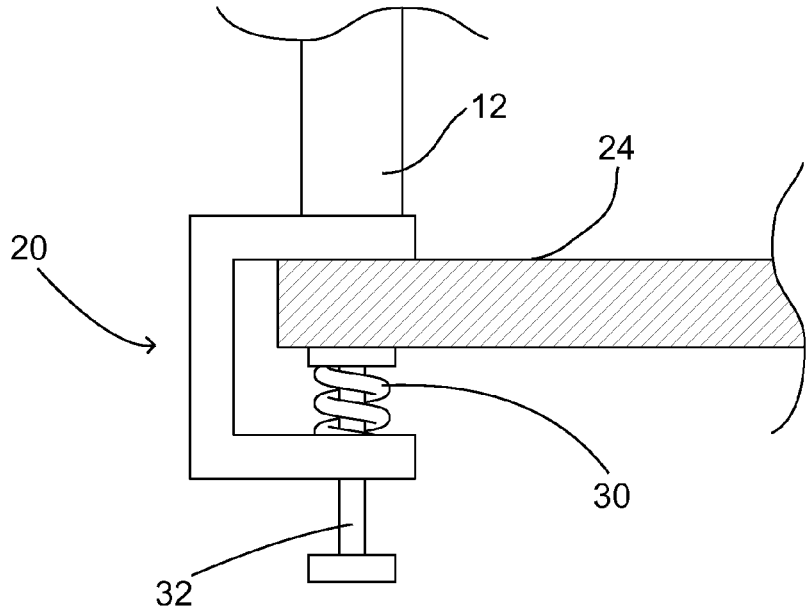
FIG. 4 is a partial side cross-sectional view of a table attachment according to another embodiment of the present application.

In another example, shown in FIG. 4, a table attachment 20 is shown which is similar to that shown in FIG. 3, but employs a spring 30 and piston 32 instead of a threaded fixation screw 22 to clamp the table attachment to the edge of a table, countertop or other surface 24.

What is claimed is:

1. A table tent comprising:

a roof at least partially constructed of a waterproof and substantially clear flexible material;

a roof structure supporting the roof;

at least one gutter configured to at least partially redirect precipitation cascading from at least a portion of the roof;

an accessory holder attached to the roof, the accessory holder including an elongated pouch configured to hold a flag or banner pole, the elongated pouch also including a string attachment point;

wherein the roof is rectangular with an elevated ridge aligned with a longer dimension of the roof and the gutter is aligned along an edge of the roof that is parallel to the longer dimension:

at least one post connected to and supporting the roof structure;

a curtain rod located at or near a bottom of the roof that is separate from the roof structure;

at least one sidewall constructed of an open material, the at least one sidewall extending vertically from the roof towards a surface upon which the table tent is resting and extending laterally around at least a portion of a perimeter of the roof; and at least one attachment configured to removably attach the at least one post to the surface upon which the table tent is resting, the attachment including a threaded member configured to impinge an opposite side of the surface from the at least one post, wherein the at least one sidewall includes holes at a top portion thereof, the curtain rod being inserted through the holes of the at least one sidewall such that the at least one sidewall is slideable on the curtain rod so that it is at least partially retractable from an extended position to a retracted position in which at least a portion of a side of the table tent is exposed.

2. The table tent of claim 1, wherein the roof of the table tent is rectangular and comprises four posts connected to and supporting each corner of the roof structure.

3. The table tent of claim 2 wherein the table tent includes at least two sidewalls that each include holes at atop portion thereof, the curtain rod being inserted through the holes of the at least two sidewalls such that the at least two sidewalls are slideable on the curtain rod, each sidewall being at least partially retractable from an extended position to a retracted position such that when two sidewalls are in a retracted position, at least turn portions of one or more sides of the table tent are exposed.

4. The table tent of claim 3, wherein the at least two sidewalls are configured to removably attach to one another.

5. The table tent of claim 1, wherein the at least one post is removably connected to the roof structure.

6. The table tent of claim 1, wherein the sidewall extends from the roof to a predetermined non-zero distance above the surface upon which the table tent is resting sufficient to allow a user to access an interior of the table tent without contacting the sidewall.

7. The table tent of claim 1, further comprising an outer sidewall constructed of a waterproof flexible material extending vertically from the roof adjacent to and distal from the at least one sidewall constructed of an open material.

8. The table tent of claim 1, wherein the at least one sidewall extends laterally around substantially the entire perimeter of the roof.

* * * * *